US005975207A

United States Patent [19]

Smitherman

[11] Patent Number: 5,975,207

[45] Date of Patent: Nov. 2, 1999

[54] METHOD AND APPARATUS FOR HANDLING DRILL PIPE IN A DEVIATED WELL

[76] Inventor: Eugene A. Smitherman, 5433 Westheimer, Suite 604, Houston, Tex. 77056

[21] Appl. No.: 08/975,850

[22] Filed: Nov. 21, 1997

[51] Int. Cl.[6] ..... E21B 19/22; E21B 37/00

[52] U.S. Cl. ..... 166/312; 166/50; 166/77.1; 166/77.3; 166/384; 175/52

[58] Field of Search ..... 166/77.1, 77.3, 166/242.2, 222, 50, 77.2, 71, 384, 312, 380; 175/52

[56] References Cited

U.S. PATENT DOCUMENTS

| | | | |
|---|---|---|---|
| 3,559,905 | 2/1971 | Palynchuk | 242/54 |
| 3,677,345 | 7/1972 | Sizer | 166/77 |
| 3,724,567 | 4/1973 | Smitherman | 175/203 |
| 4,848,455 | 7/1989 | Fenyvesi | 166/77 |
| 4,909,325 | 3/1990 | Hopmann | 166/312 |
| 5,360,075 | 11/1994 | Gray | 175/61 |
| 5,547,314 | 8/1996 | Ames | 405/165 |
| 5,845,708 | 12/1998 | Burge et al. | 166/77.3 |
| 5,865,249 | 2/1999 | Gipson et al. | 166/312 |
| 5,875,850 | 3/1999 | Burge et al. | 166/385 |

*Primary Examiner*—Hoang C. Dang
*Attorney, Agent, or Firm*—Gunn & Associates, P.C.

[57] ABSTRACT

Apparatus and methods for completing deviated and vertical sections of well borehole are disclosed. Drill string in moved into and out of the well borehole in one continuous piece without breaking it into smaller sections. A slotted casing section is attached to the lower end of the drill string and forced to a target production zone by inserting the drill string into the well borehole using a vertical chain drive. Once positioned typically in a production zone, the slotted casing string is disconnected from the drill string and the drill string is removed. Intermediate casing is then positioned in the borehole to extend from the top of the slotted casing string into surface casing, and the intermediate casino string-borehole annulus is cemented.

25 Claims, 5 Drawing Sheets

100
101
102
104
110
112
114
125
126

METHOD AND APPARATUS FOR HANDLING DRILL PIPE IN A DEVIATED WELL

A method and apparatus for handling drill pipe is set forth in U.S. Pat. No. 3,724,567, an invention of the present inventor. That disclosure sets forth a method of joining an entire drill string of pipe so that the drill string is used as a unit, substantially without unthreading once the drill string has been made up. As will be understood, a joint of pipe is added at the surface as the drill bit advances. The advantage of the apparatus set forth in that patent is that tripping the drill string out of the well borehole is accomplished much faster. Moreover, pipe storage is accomplished in a circular trough as the drill string remains threaded together.

The present disclosure incorporates the disclosure of the prior patent by reference. The protocol set forth in that patent was limited. It did not enable drilling of highly deviated wells. In fact, deviated wells have become significantly more commonplace. This is especially true in offshore situations. Elaborating, assume that a formation worthy of production by multiple wells has been identified beneath a body of water. In that event. after a first well is drilled, typically proving up the formation, a production platform is normally designed and constructed, and then is towed to the location and erected. In shallow waters, the production platform may have legs extending to the mud under the body of water. Recently, several production platforms have been deployed in waters deeper than 1,000 feet in the Gulf of Mexico. Those platforms are supported on cables to a number of anchor points under the water. They are supported on tension legs as the term is applied to that type equipment. Whether with a drilling vessel or production platform, it is thereafter necessary to drill a number of wells to exploit the full scope of the producing formation. In water depth ranging from perhaps 20 feet on up to 1,200 feet, it is necessary to support a number of wellhead connections at the single production platform, or directly under it supported on a sea bed. It is not uncommon to operate perhaps 30 or 40 wells from a single platform. Inevitably. only a few of the wells are more or less straight even though they themselves may slant at a slight angle, perhaps 5, 10 or 15°. The more commonplace occurrence is well deviation of a substantial amount. The well may have a vertical portion which terminates at a bend in the well which extends laterally for several hundred or several thousand feet. The remote end of the well may be vertical, i.e., penetrating the formation of interest at a remote location, and even still may include another bent portion. i.e., a terminal portion of a few hundred or a few thousand feet following the formation of interest. Instead of merely penetrating a producing zone from the vertical as occurred forty or fifty years ago, the production zone for the well (hence the perforated zone) may be several hundred feet in length as the terminal end of the well borehole follows the dip of the formation. If for instance the formation is inclined at a 30° angle below the horizon, the last producing portion of the well will inevitably follow that kind of angle. It is not uncommon to even end up drilling horizontally to follow the formation. While the formation may be miles in length, and relatively thin, the production pay zone can be elongated to several thousand feet even though the formation is only perhaps 100 feet in thickness.

The present disclosure is concerned with drilling a deviated well and making well completions in the deviated well. That procedure cannot be done utilizing the old fashioned manner forming a set of perforations where the well is vertical and the producing formation is vertically intercepted. The dip of the formation is now utilized to increase the number of perforations and the perforation length adjacent to the casings In drilling an offshore well, it is sometimes necessary to drill through a conductor pipe and then drill through a partially cased well. As a generalization, the amount of production from a well is increased significantly as the production pay zone is increased. Consider for example a producing sand which is 100 feet in thickness. It is not always possible to precisely locate the top or bottom interfaces defining that zone. While it may be known to have a thickness of 100 feet from seismic information. and data from adjacent wells in the same formation, the set of perforations may coincide only with a portion, perhaps one-half of the zone. Such vertical alignments are not always easily made so that the string of perforating guns may be positioned slightly high or slightly low. Problems arise with such measurements in that cable stretch and the like may offset the perforations ever so slightly. By contrast, in drilling a well with a mud motor and steering tool and deviating the production portion of the well borehole so that it tracks the production sand, the production pay zone can be elongated tremendously. Even though the formation may have a thickness of 100 feet, the production pay zone is several hundred feet, and as much as one thousand feet. That increases the amount of production taken from the zone. This is an important aspect of the present invention.

In an offshore location, and especially from a production platform where forty wells are drilled, and most of them are highly deviated, the present apparatus and method set forth a better way of reaching the furthermost areas of the production pay zone and enable drilling of a well borehole into that zone for optimum production. The amount of production is increased because the formation is tracked by the r emote end of the well borehole.

The present invention solves the problem of retrieving the drill string to service the lower end, typically replacement of the drill bit, and putting slotted casing in the well, without the tedious problem of making up the drill string to return it to the well bore. In times past, this has been solved by stacking 90 foot stands of pipe in the derrick as the drill string is slowly disassembled and re-assembled. The present invention provides an apparatus and method of retrieving the drill string as it emerges from the well bore and bending it toward the horizontal and curling the drill string in a circular storage container.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

DETAILED DESCRIPTION OF A PREFERRED EMBODIMENT

The present disclosure describes the procedure of drilling as taught in U.S. Pat. No. 3,724,567 of the present inventor. That procedure will be described first and then procedural steps will be given which correlate to drilling a deviated well. That description will be given first and is devoted primarily to a vertical well. That is only the beginning of the situation and problem which is solved by the method and apparatus of this disclosure.

Figures 1, 2:
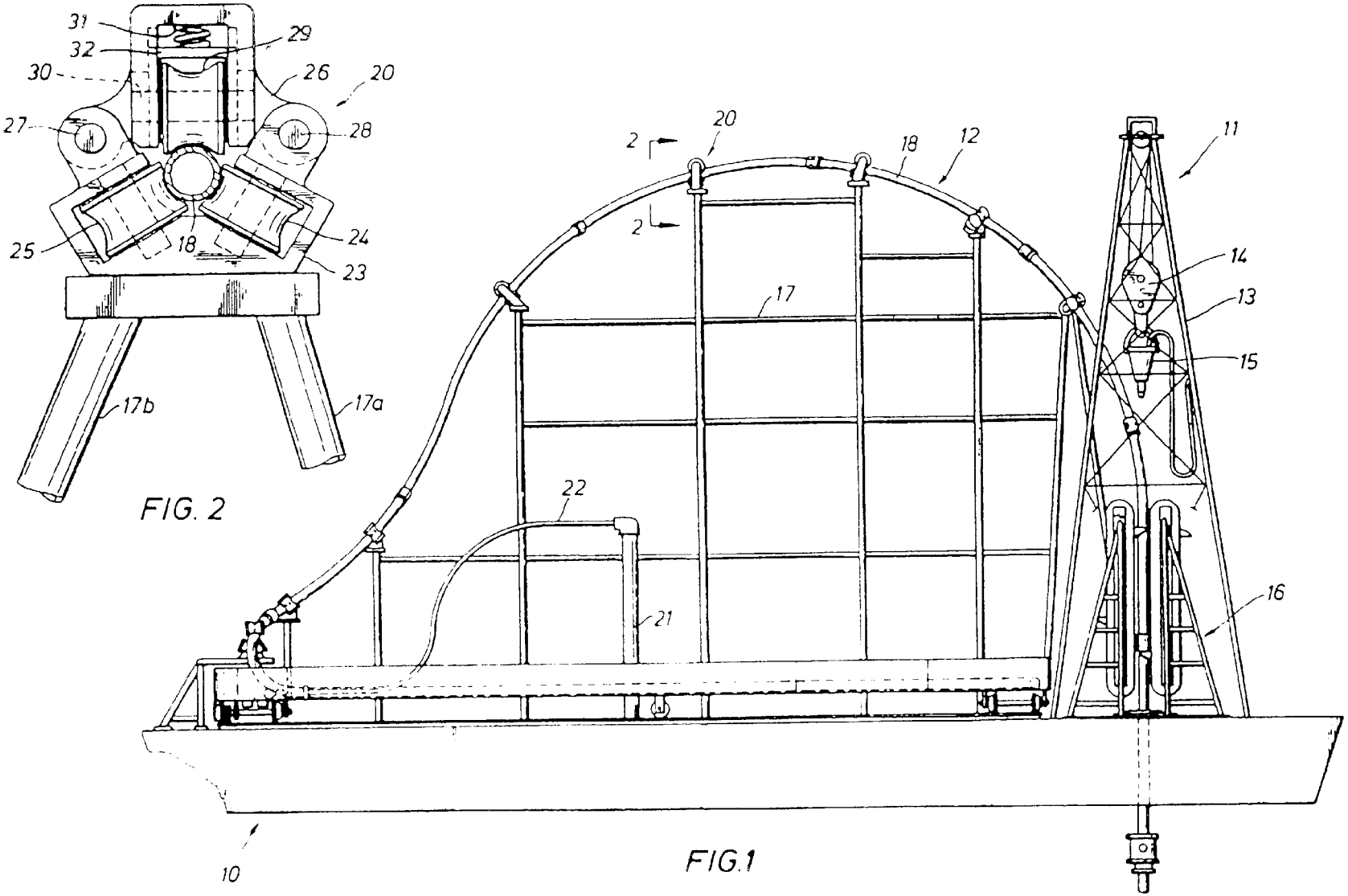
FIG. 1 shows the drill string removal apparatus of the present invention cooperative with an offshore drilling rig and derrick.
FIG. 2 is a sectional view taken along the line 2—2 of FIG. 1 illustrating details of construction of a drill pipe guide.

Attention is first directed to FIG. 1 of the drawings. In FIG. 1, the numeral 10 illustrates a conventional drilling barge of satisfactory construction, having a derrick and associated drilling apparatus indicated generally at 11. The present disclosure includes an offshore drilling barge. Since the apparatus of the present invention is readily usable on land, the offshore barge constitutes no limitation on the present invention. The barge 10 carries the drilling equipment indicated generally at 11. The numeral 12 indicates the apparatus of the present invention which is an apparatus which stores the drilling string, without regard to its lengths as it is removed from the well bore. The whole drill string is pulled in typical use of the present invention, whereupon it is scribed and thereafter returned to the well bore. The present invention enables the removal of the entire drill string without breaking it down into stands of pipe, which is both time consuming, tedious and dangerous. Considering the present invention more in detail, the numeral 10 indicates the offshore drilling barge which is conventional construction and which provides the context for installation of the present invention. The numeral 11 indicates the drilling equipment which includes a conventional derrick 13, traveling block 14, swivel 15, and the necessary Kelly and rotary table. An elevator apparatus at 16 retrieves the drilling string from the well bore when the conventional drilling operations are interrupted.

The present invention includes a suitable support structure 17 which extends above the drilling barge 10 for supporting the drill string 18 as it is retrieved from the well bore. The structure 17 provides support for the drill pipe 18 which tends to be quite heavy, and support for the means for guiding and redirecting the pipe 18 to the storage means, as will be described. Conventionally, the pipe emerges from the well bore pointing essentially directly upwardly. The support structure of 17 is cooperative with a pipe guide means 20 as will be described with regard to FIG. 2, which redirects the slight bend in the pipe from the vertical preferably to the horizontal and then directs it tangentially toward a circular storage rack which can accommodate several turns or laps of the pipe. Of course. the pipe 18 may be stored in some other configuration or in some other plane.

Figure 7:
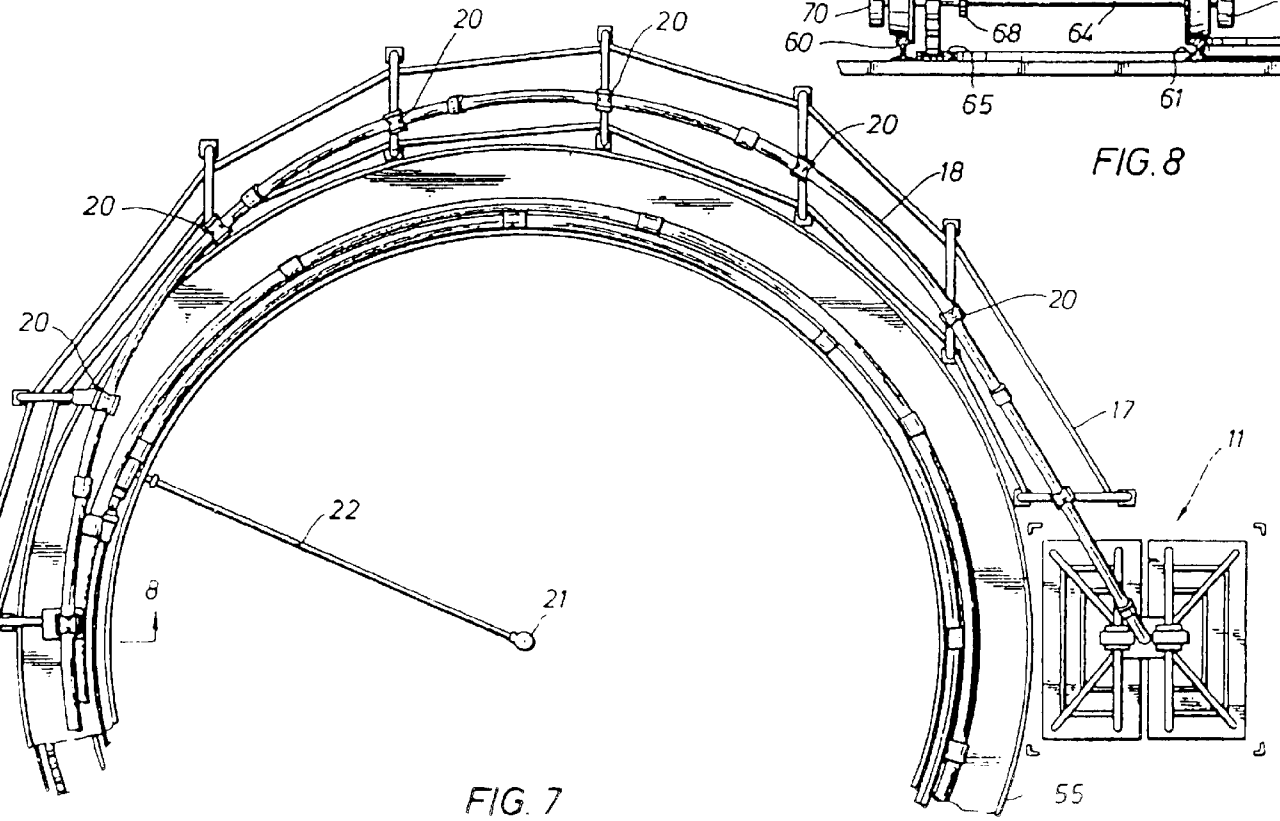
FIG. 7 is a top or plan view showing the circular storage apparatus for the drill pipe in conjunction with the derrick.

The support means 17 is thus a structural steel frame which projects into the air and holds the pipe guide means 20 at various locations along its length. Each of the pipe guides is connected to and held up by the structural support 17. Hence, the structure 17 may take any form, but the pipe guides 20 carried at its upper edge as shown in FIG. 1 are located along the arc of a circle which is determined by the desired hending, radius of the drill pipe 18. In further particular a top view. as will be described with regard to FIG. 7, shows also that the structure 17 begins curing the drill pipe 18 for storage.

FIG. 1 further includes an upstanding pipe 21 and a flexible pressure hose 22 which supplies drilling mud to the storage rack of the present invention. If desired, the drilling string can be retrieved from the well bore in communication with the mud pump so that as the pipe is pulled from the well bore, additional mud is being, forced through the entirety of the drill string, back into the well bore. This is the safety factor which prevents a bubble of gas or, pressure fluid from a geological formation from rising, too rapidly in the well and creating, a dangerous condition as would be the case if the well bore were left open, either in the annulus adjacent the drill pipe, or in the drill pipe itself.

Attention is next directed to FIG. 2 of the drawings which shows a pipe guide means 20. The pipe guide means 20 is located at the upper perimeter of the support structure 17. The numerals 17*a* and 17*b* in FIG. 2 indicate various and sundry leas of the support structure 17 which carry the pipe guide means 20 and is duplicated at various points along, the path of the drill pipe 18. Only one such guide means may be described and the others will be sufficiently similar thereto, differnce, substantially only in location, that a detailed description of all the pipe guides is not needed. The pipe guide means 20 includes a fixed body 23 which supports a first roller 24 and a second roller 25. The rollers 24 and 25 are free wheelingy guide rollers which are carried on suitable axles which are supported in the body 23. As shown in the drawings, the rollers 24 and 25 have an outer surface which is shaped to accommodate the drill pipe 18. The drill pipe 18 is thus cradled by the rollers 24 and 25. In addition, the upper portion of the guide means includes a body 26 which is hinged both at the right and at the left. The body 26 is hinged at 27 and 28 and a suitable pin is placed in the hinges to join the body 26 to the body 23. The body 26 incorporates a roller 29 in contact with the pipe 18. Moreover, the spring, 31 bears against a U-shaped bracket 32 which straddles the roller 29 and bears against the shaft 30 at both ends. Suitable bearing are included in the rollers 24, 25 and 29 to permit their free rotation. As the shaft 30 is forced toward the pipe of the U-shaped bracket, the roller 29 is kept in constant contact with the drill pipe 18. As the upsets on the pipie pass through the guide means 20, the spring, 31 is compressed and the roller 29 moves upwardly as shown in FIG. 2. This permits the guide means to keep constant pressure on the drill string, 18, and, as a consequence, the several guide means along the length of the support structure 17 redirect the drill pipe from the vertical to the horizontal and at a level approximately coincident with the drilling platform for storage in a circular storage means as will be described.

Figure 3:
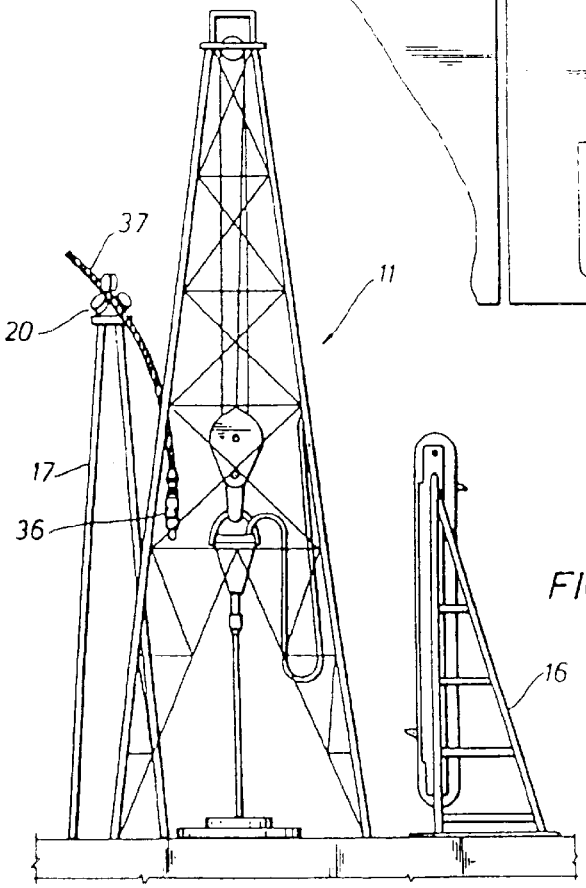
FIG. 3 is a partial view showing the derrick and conventional drilling apparatus cooperative with the present invention moved aside to permit its storage and continued drilling by the derrick.

Attention is next directed to FIG. 3, which shows the conventional drilling apparatus as it is customarily used. The drilling apparatus is shown with the Kelly engaged by the rotary table during conventional drilling operations. The elevators 16 are moved aside inasmuch as they do not contribute to the drilling process, but are best used during retrieval and return of the drill string to the well bore. Of particular interest in FIG. 3 is the location of the elevators 16. They can be moved to the side and stored indefinitely. In addition, FIG. 3 illustrates the location of a certain connector 36 carried on a lead line of wire rope 37 or the like which is threaded through the various and sundry guide means 20 of the present invention. The connector 36 is connected to the upper end of the drill string as it is retrieved. The wire rope and connector 36 are then used to pull the upper end of the drill string through the apparatus of the present invention for storage. Once the drill pipe 18 is snaked into the apparatus, the drill string is pulled rapidly from the well bore.

Figures 4, 5:
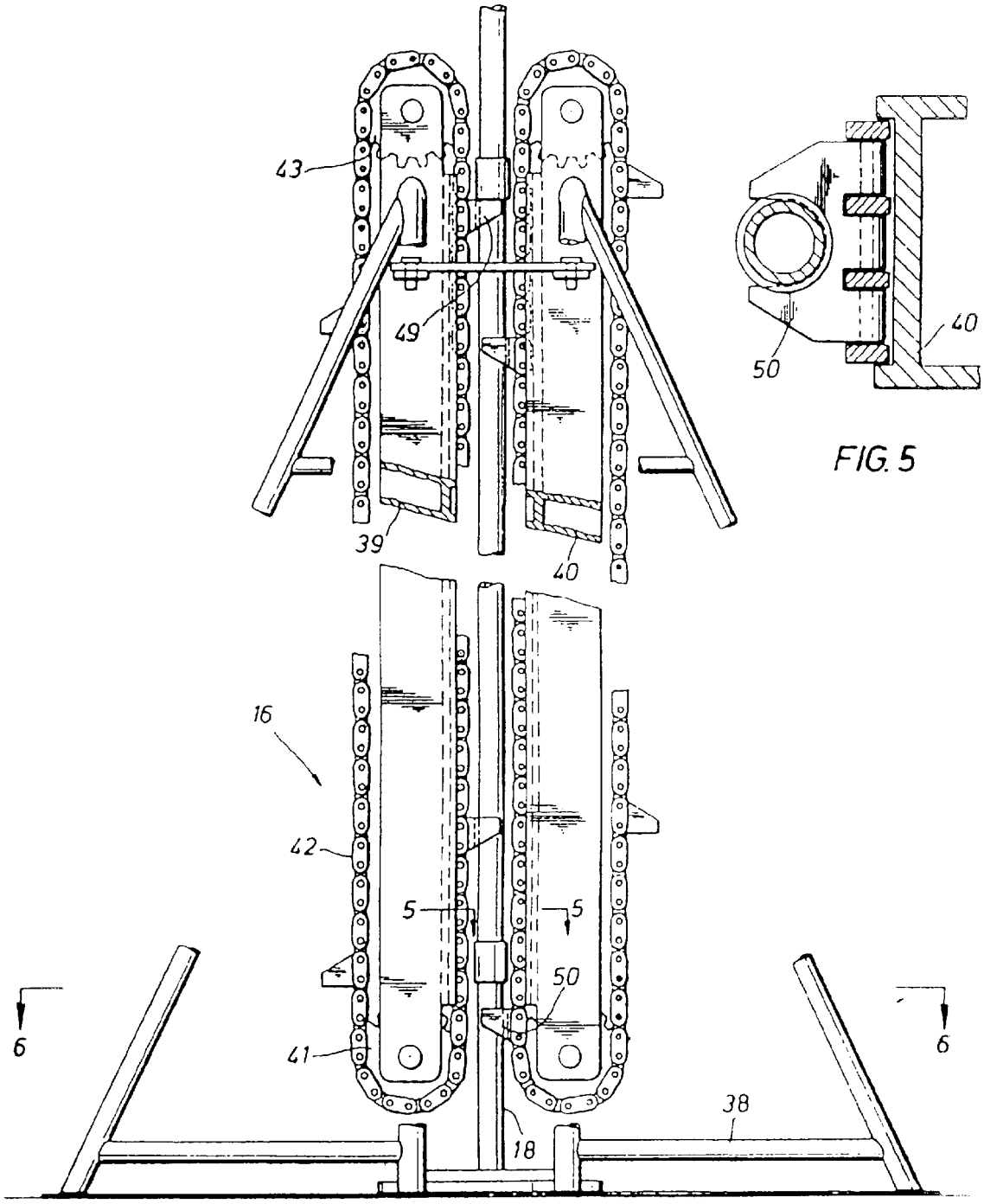
FIG. 4 illustrates in detail a pipe elevator system which removes the drill string from the well bore and directs it toward the apparatus of the present invention.
FIG. 5 is a sectional view taken along the line 5—5 of FIG. 4 showing the elevator apparatus of FIG. 4 engaging the tool joint.

Attention is next directed to the elevators 16, best illustrated in FIG. 4. The drill string is indicated by the numeral 18 as it emerges from the rotary table. In conventional operations, the drill string has collars located approximately every 30 feet. The collars are engaged and lifted by the elevator means 16 which is a dual track conveyer belt vertically directed for withdrawing the drill pipe. Briefly, the elevators 16 include a support structure 38 of suitable framing members for holding the conveyors in their proper position relative to the drill pipe 18. The support structure 38 is in the form of an A-frame and supports vertical structural members 39 and 40 about which the traveling conveyors move. The frame member 39 supports a lower sprocket which is engaged with the left-hand chain 42. The structural member 39 also supports an upper sprocket 43. The chain 42 feeds over the sprocket 32 and thus travels vertically upwardly adjacent to the drill pipe 18 when retrieving the pipe.

Figure 6:
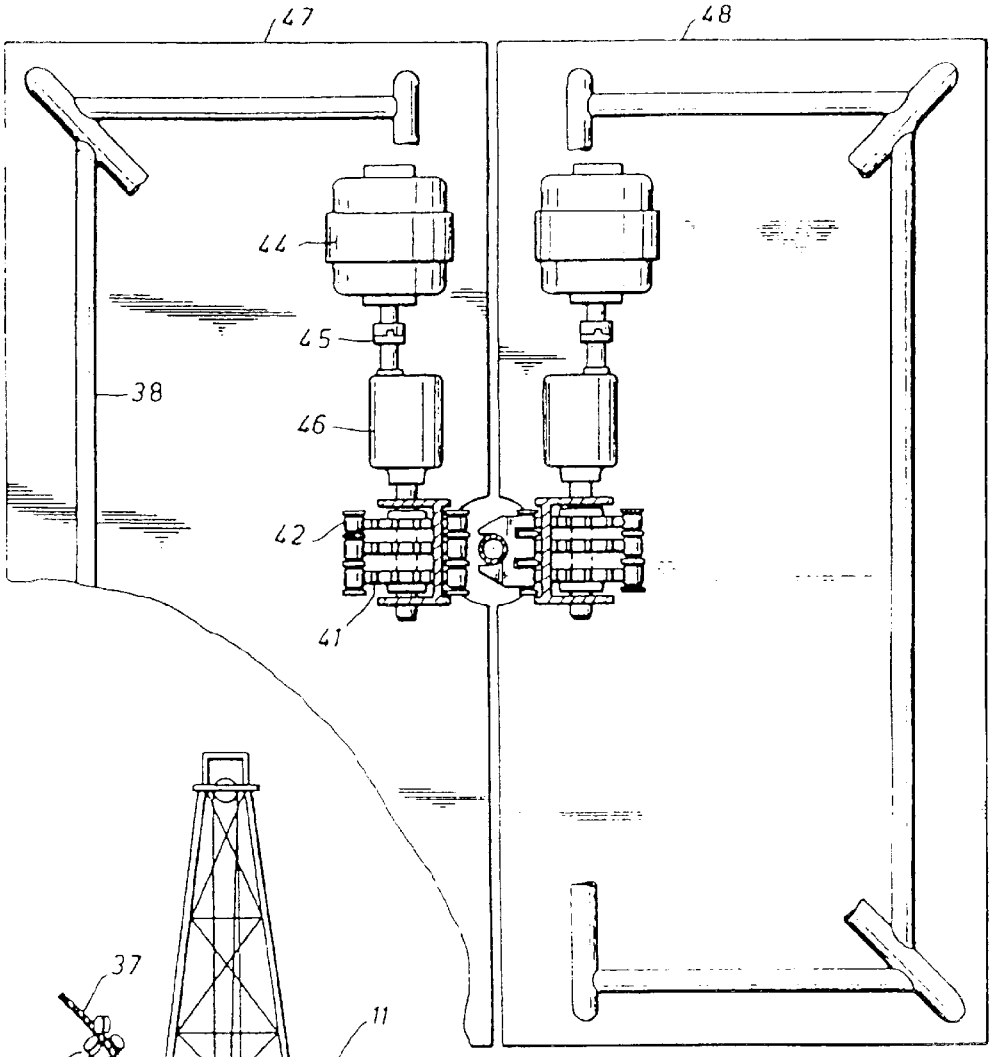
FIG. 6 is a sectional view taken along the line 6—6 of FIG. 4 illustrating details of construction of the pipe elevators.

Attention is momentarily directed to FIG. 6 of the drawings which is a sectional view through the lower portions of the pipe elevators 16. In FIG. 6, the lower sprocket 41 is shown to be a trio of sprockets which are nested on a common shaft adjacent to one another, and which are rotated by a suitable motive source 44. Typically, the source 44 is an electric motor which has an output shaft, a suitable coupling 45. and gear box 46. The gear box 46 is connected to the sprocket 41 for driving the conveyor belt 42.

As shown in FIG. 6, the elevator means 16 is supported on separable platforms 47 and 48 which divide along the center line. It will be understood that one conveyor belt is positioned on one side of the drill pipe 18, and the other is positioned on the other side. Hence, it is quite convenient to divide the apparatus so that it may conveniently sit on or above the drilling platform, centered at the rotary table.

It will be noted that the right-hand portions of the elevator means shown in FIG. 6 are identical to the left-hand portions. It is believed that a detailed description of this additional apparatus is not necessary, and would be unduly burdensome on the disclosure.

Returning again to FIG. 4, it will be noted that the left-hand elevator system has engaged the drill pipe 18 on a pipe carrier 49. Additionally. the right-hand conveyor system is shown moving a pipe carrier 50 to engage the next collar in the drill string 18. The alternating engagement of the left and right-hand conveyors should be understood to provide a means whereby first one collar is engaged by one conveyor and the collar next emerging from the well bore is engaged by the other conveyor. Drill pipe is customarily manufactured in 30-foot lengths. Hence, the spacing between collars is approximately 30 feet. Because of the 30-foot spacing of collars on the drill string of the conventional drill pipe in use today, it will be understood that the elevator means 16 of FIG. 4 extends somewhat taller than 30 feet. The preferred range is 35 to 40 feet, with the conveyor extending the full length of the apparatus. The lower sprocket 41 can be located immediately above the rotary table with perhaps a foot or so clearance. This, then, permits the pipe lifts 49 and 50 to grasp the pipe as it emerges from the well bore.

Attention is directed to FIG. 5 which shows the lower pipe lift 50 in greater detail. The pipe lift 50 projects laterally from the chain as it moves vertically. It engages the drill collar on its nether shoulder, and lifts the drill pipe 18 upwardly. As shown in FIG. 5. the pipe lifter 50 has a U-shaped slot which fits snugly against the side wall of the pipe. As the pipe lift 50 moves faster, it lifts the collar from its lower shoulder and helps draw the drill string from the well bore As shown in FIG. 5 the pipe lift 50 is carried on at least two or three pins to various chain lengths comprising the lift chain of the elevator, and hence. extends riigidly to the left, and is guided and maintained in this posture by a channel formed in the structural member 40. This is a suitable means tor engaging the pipe 18, and pulling it from the well bore.

It should be noted that the two conveyors alternate in grasping first one collar and then the next of the drill pipe 18 as it emerges from the well bore. When one side loads up, there is a tendency for the motor to slow down, and that side travels a little bit slower because of the load. The other conveyor will be unloaded at this juncture and the motor will tend to speed up, rushing the pipe lift means of that elevator to a position immediately adjacent to the drill pipe for lifting purposes. Thus, as shown in FIG. 1, when the pipe lift 49 reaches the top of its travel and tends to rotate to the left and withdraw from the collar of the pipe 18, the pipe lift 50 at the lower portions of FIG. 4 will come into engagement with its drill collar. The motors may be controlled by hand or suitable speed controllers. In this manner, the pipe lift 50 tends to overtake the drill collar, and this sequence is repeated throughout the entire drill string.

To this juncture, sufficient structure has been described for withdrawing the drill string from the well bore and guiding it on the structural support member through the use of the means 20. Attention is now directed to FIG. 7 wherein the means for storing the pipe in a horizontal loop is described. In FIG. 7, the numeral 11 indicates the drilling apparatus which is conventionally found in conjunction with the present equipment. The numeral 17 indicates the structural support member previously described for holding the drill string 18 as it is bent from the vertical toward the horizontal, and forced to a horizontal point approximately parallel with the deck of the drilling barge 10. In FIG. 7, it will be noted that the structural support 17 incorporates several guide means 20 which continuously bend and redirect the drill pipe 18 tangentially toward a circle. As was discussed, in regard to FIG. 1, the structural support 17 provides compound bending to the pipe 18 as it is redirected to the storage means as will be described.

Figure 8:
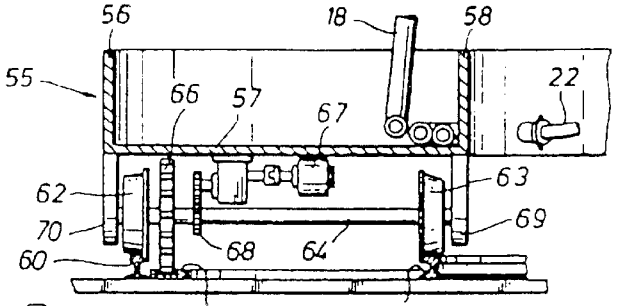
FIG. 8 is a sectional view taken along the line 8—8 of FIG. 7 illustrating details of construction of the pipe storage means of the present invention.

In FIG. 7, a circular storage means is indicated by the numeral 55. It preferably comprises a completely encircling storage rack best illustrated in FIG. 8. In FIG. 8, the means 55 will be observed to include a side wall 56 and a bottom wall 57, and an internal side wall 58. The walls 56 and 58 are parallel to one another and are concentrically located.

The wire line 37 is threaded through the various pipe guide means 20 shown in FIG. 7, and one or two revolutions of the line 37 are stored in the circular storage means 55. The connector 36 (see FIG. 9) connects through the drill string 18 for the purpose of pulling the drill string 18 from the well bore through the various guide means and then to the storage container 55. The circular storage trough or rack is rotated to pull the lead line 37, the connector 36 and then the drill string through the various pipe guides 20 and into the storage trough or rack. As the drill pipe 18 is stored and the storage through or rack is rotated, additional drill string is pulled from the well bore into the storage rack 55.

In FIG. 8, the storage rack 55 is shown including the means which rotate the storage rack as the drill string 18 is accumulated in several turns or revolutions. The storage means 55 is carried on a pair of rails 60 and 61. Wheels 62 and 63 carried on a common axle 64 support the storage rack on the rails 60 and 61. The wheels and associated axle are located at several points about the circumference of the storage rack 55 to support the entirety of the circular structure on the rails. Additionally, a circular rack 65 is located immediately inboard the outer rail 60. The rack 65 is engaged by a pinion 66 which is common to the axle 64. The pinion 66 is keyed to the axle 64 and in response to operation of a motor 67, the storage rack is rotated. The motor 67 is provided with a conventional coupling, gear reduction box, and suitable gears at 68 for imparting the rotation to the common axle 64 and the pinion 66. As the motor 67 operates, the storage rack 55 is rotated at a rate of speed determined by operation of the motor 67.

As mentioned above, a suitable number of wheels are arranged about the pipe storage rack 55 to carry the rack and maintain it level as it rotates on the rails 60 and 61. The axle 64 is supported by a pair of downwardly extending journals 69 and 70 which are appended to the lower side of the storage rack 55.

Figure 9:
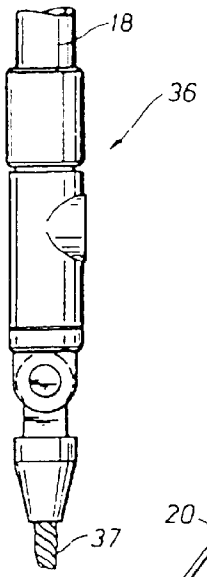
FIG. 9 is a connector which is joined to the upper most end of the drill string as it is removed from the well bore for pulling the drill string through the apparatus of the present invention to be stored.

The length of the lead line 37 should be so calculated that when it is fully retrieved and placed in the storage rack, it positions the connector 36 of FIG. 9 immediately adjacent to an opening in the side wall 58 of the storage rack 55. As shown in FIG. 8. this permits the mud line 22 to connect through the side wall 58 so that the mud line is then connected with the drill pipe 18 through a T-connection provided in the means 36 as shown in FIG. 9. The apparatus can be interrupted in its operation rind the storage rack stopped while this connection is made once the first few hundred feet of drill pipe 18 have been retrieved from the well bore.

DRILLING AND COMPLETING DEVIATED WELLS

Figures 10, 11:
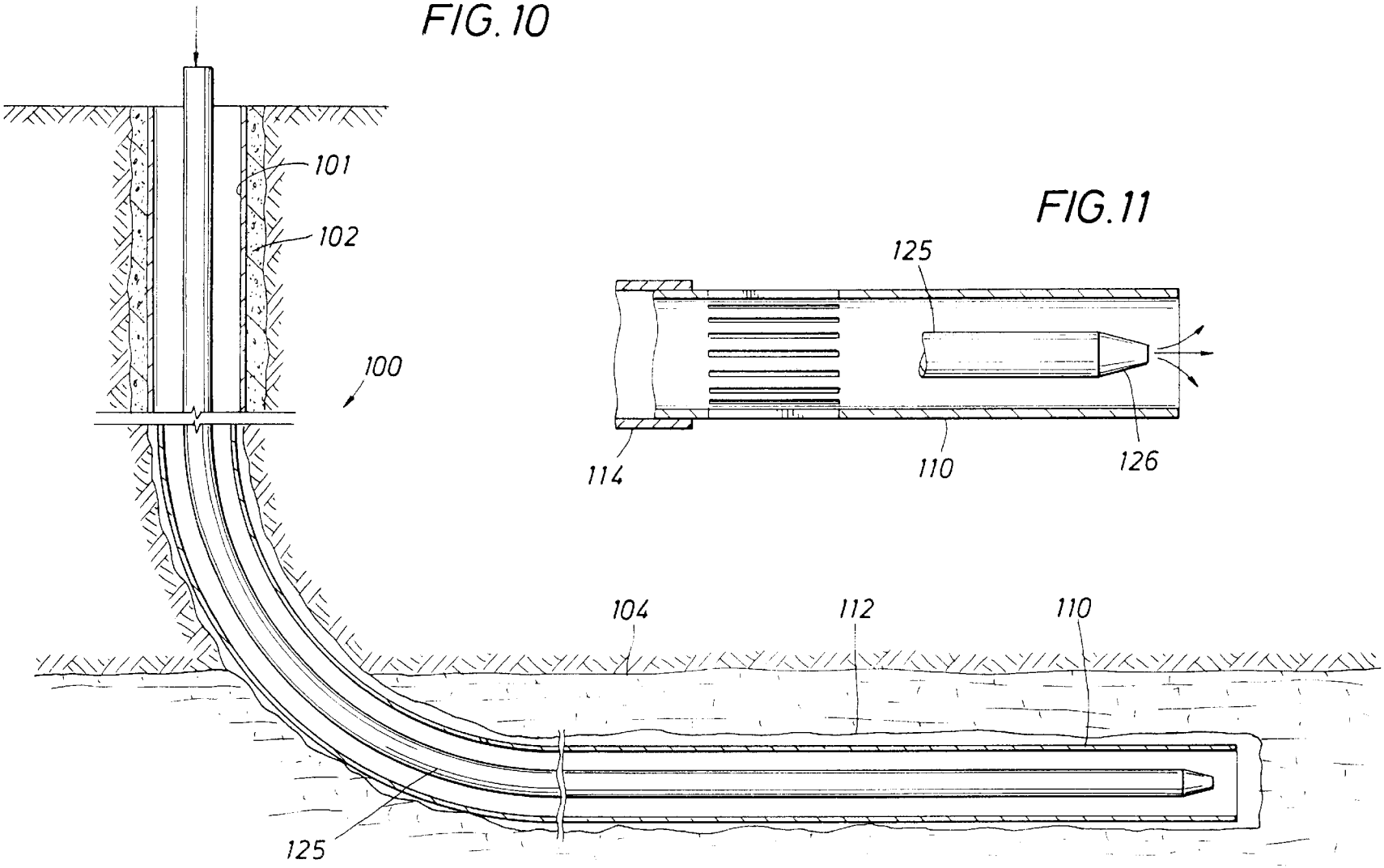
FIG. 10 is a view of a well borehole deviated into a producing formation.
FIG. 11 shows a slotted casing which is installed in the deviated well borehole portion to obtain production from the formation of interest.

Attention is directed to FIG. 10 of the drawings. It shows a deviated well. To be sure, the top end of the well is normally straight and vertical. It has been partly cased in FIG. 10. The deviated well 100 incorporates a cased pipe 101 which is held in position by the cement 102. Normally, there is a conductor pipe (not shown) which extends from the sea bed up to the drilling vessel. That has been omitted for clarity. The cased portion extends downwardly at least at few hundred feet, and perhaps for a substantial portion of the well borehole. The pipe 101 should be noted, and in particular, its size should be noted. At this point, the ID of the cased pipe must be larger than the OD of the drill bit. The pipe string is formed of drill pipe. It has to be smaller to fit in the casing 101. These dimensions will be described later.

Moving to the lower portions of FIG. 10, the deviated well is shown with the remote portion in the producing zone 104. The producing zone 104 may or may not have some dip. The plane of the view makes the formation appear horizontal. In other words, the formation may have dip at an angle to FIG. 10.

The remote or distal portion of the well will he described as the producing zone. The production borehole is drilled at any selected angle with respect to the horizon, even actually drilling horizontally. This is accomplished by a steering system cooperating with a mud motor and drill bit. After drilling, all of that equipment is retrieved from the borehole.

The next step leaves the production zone clear, i.e., it is an unfused or unlined well borehole. All the equipment is retrieved to the surface. Then, a slotted pipe is affixed to the lower end of the drill string It is connected with a joint which unthreads with conventional rotation to the right. Ordinarily, drilling is done by advancing the drill bit with rotation to the right or in a clockwise direction looking down at the rotary table.

Rotation tightens the threaded connections in the drill string. This is done so that the drill string will not unthread accidentally, leaving a part of the drill string in the borehole. In this particular instance a string of one or more slotted pipe joints 10 is assembled at the lower end of the drill string. The drill string is conventional drill pipe as before. The lower end of the drill stem is changed by omission of the drill bit and drill collars. and substitution of a string of one or more joints of slotted pipe 110. The slotted pipe 110 is positioned within the well borehole so that it "lines" a zone of interest, which is typically a production zone 112. At this zone 112, it is not possible to accurately cement the slotted pipe, or any other pipe such as intermediate casing, in place in the center of the borehole because of the deviation of the borehole. Rather, the pipe normally falls to the side, i.e., to the bottom of the hole and is eccentered. When eccentered, the cement is forced to the high side of the hole and makes an undesirable cement job. Slotted pipe is normally provided in standard lengths. With the appropriate threaded pipe joints, the slotted pipe is extended to an adequate length. Indeed, any number of joints can be threaded together to comprise the production zone casing for this well.

In vertical wells, when the casing string passes through the production zone, produced oil and gas fluids are obtained from the production zone flowing into the well through perforations. Perforations are formed by shaped charges which are detonated to form deep perforations extending through the steel pipe, through the surrounding cement and into the formations. In this particular instance the slotted pipe 110 is placed in the production formation 112 to produce oil and gas flowing from the formation through the slots. The present procedure contemplates the attachment of the slotted pipe 110 to the end of the drill string. It is connected with a reverse threaded connection 14 which unthreads when the slotted pipe is installed. Many slotted pipe joints are threaded together with conventional pipe couplings. The coupling is threaded so that it will not unthread after it has been pushed into the production zone.

At the time of installing the slotted pipe 110 all the threaded joints in the drill string and the several slotted pipe joints in the string are treaded in the same direction except the topmost pipe 110. The top joint is threaded so that it unthreads when rotation is applied to the drill string. Since the several joints of slotted pipe are threaded together, they are pushed to the far end of the borehole. The drill string is used to push the slotted casing in place, which typically is placement in a zone of interest such as a production zone. At this juncture the drill string is pulled completely from the well borehole and then stored in the circular trough thereby leaving the slotted casing in the production zone.

The threaded joint 114 is reverse threaded as noted above. Once that threaded joint is made up, the drill string is then forced into the well borehole to lower the slotted pipe (typically several joints thereof). Weight is applied to assist gravity pull on the drill string. So long as gravity is effective, the slotted pipe 110 is lowered. When gravity pull is no longer sufficient, force is applied from the surface. The slotted pipe 110 must be forced into deviated well portion 12 and is pushed to the far end. The radius of curvature is controlled to assure that completion can be carried out in this manner. The elevators at the surface are then reversed to force the drill string downwardly. After the drill string has been pushed to the maximum penetration in the production zone, rotation in the correct direction unthreads the slotted pipe joint 110 and leaves that in position. The next step in the procedure is to retrieve the drill stringy. This then leaves the borehole 112 protected with the slotted pipe at the bottom and cased at the top. Typically, there will be an uncised portion between the two. That uncased region is spanned with a casing string installed to the slotted pipe 110. It is run into the well borehole and installed. The casing is installed by threading to the slotted pipe 10. The length is selected so that the new casing extends up to the surface casing 101.

Note should be taken of the diameters of the several pipes just mentioned. First of all, the surface casing is typically quite large. It has a fairly large ID, usually more than 10 or 11 inches. The slotted pipe 110 is smaller than the open borehole in the formation. Assume, for purposes of illustration, that the surface casing is larger than 11 inches. Assume that the drill bit on the drill string cuts to a diameter of about 7.5 inches. The slotted pipe typically will be about 6 inches OD. It is lowered on the drill string. The drill string itself is normally smaller than the slotted pipe. perhaps 4 to 4.5 inches. When the slotted pipe 110 is positioned as illustrated, it is open at the upper end. Then, the intermediate casino string is installed. It is preferably larger than the slotted pipe 110 and smaller than the surface casing 101. This might involve a casing with an ID greater than 6 inches and an OD less than 9 inches. Typically. this casing string is spaced from the annular wall using annular spacers so that it is centered within the borehole thereby permitting cement to fill around this casing string. It is cemented in place thereby spanning the uncased portion of the well below the surface casing 101 and above the slotted pipe 110. At that juncture, a remedial step is then carried out which prepares the well for production. A spaghetti string 125, which is typically a flexible tube through which fluid can flow, is lowered into the well borehole and is pushed to the very end. It carries with it a nozzle. The nozzle is used to clean the well borehole. Trash and debris from the earth formations will collect in the slotted pipe joint 110. This results from pushing the slotted casing section into the well borehole. Generally, it must be left open while installing occurs. After the slotted casing 1 10 has been pushed to the remote end of the well borehole, then the slotted casing section wash procedure can be done. Ideally, this is accomplished after the entire well has been cased. The present procedure uses the apparatus shown in FIG. 1 to install the slotted pipe 110.

While the foregoing is directed to the preferred embodiment, the scope is determined by the claims which follow.

What is claimed is:

1. A drill pipe storage apparatus usable with a typical well drilling apparatus, which well drilling apparatus incorporates a means for withdrawing an elongate drill string from a well borehole drilled with the well drilling apparatus, comprising:

(a) a generally horizontal storage rack adapted to receive and store an assembled drill string thereon;

(b) a mud line connected to the drill string and with a supply of drilling mud and further being adapted to releasably connected with the drill string for controllably supplying drilling mud thereto; and (c) slotted casing string to be forced into said well borehole connected at the lower end of said drill string.

2. The invention of claim 1 including a vertical chain drive for moving the drill string relative to an opening of the well borehole.

3. The invention of claim 1 wherein said drill string emerges (generally vertically from a well borehole opening and further including a means for redirecting the movement thereof generally toward the horizontal.

4. The invention of claim 3 wherein said means includes at least a pair of guide means through which the drill string is directed to re-direct its movement from the generally vertical to the generally horizontal.

5. The invention of claim 1 wherein said storatge rack includes a generally circular track.

6. The invention of claim 1 including a threaded joint between a lowermost section of the assembled drill string and an upper most section of said slotted casing string, and said slotted casing string is smaller in diameter than said well borehole to enable said slotted casing string to be pushed to a production zone thereof.

7. The invention of claim 6 including a spaghetti string extending along said well borehole to said slotted casing string to wash earth materials from the slotted casing string.

8. The invention of claim 6 wherein said slotted casing string comprises two or more joints of slotted casing threaded together at slotted casing joints, and the direction of said threaded joint between said lowermost section of the assembled drill string and said upper most section of said slotted casing string is opposite to the direction of said slotted casing joints.

9. Completion apparatus usable in the completion of a deviated well drilled with a typical well drilling apparatus, which well drilling apparatus incorporates a means for withdrawing an elongate drill string from a deviated well borehole drilled with the well drilling apparatus, the completion apparatus comprising:

(a) a generally horizontal storage rack adapted to receive and store said elongated drill string thereon;

(b) a mud line connected to said drill string and with a supply of drilling mud, and further being adapted to releasably connected with said drill string for controllably supplying drilling mud thereto; and (c) slotted casing string to be forced into said well borehole connected at the lower end of said drill string when deviations in said well borehole inhibit the movement of said drill string and attached slotted casing string there through by the force of gravity.

10. The completion apparatus of claim 9 including a vertical chain drive for moving said drill string relative to an opening of the well borehole.

11. The completion apparatus of claim 9 wherein said drill string emerges generally vertically from a well borehole opening, and further including a means for redirecting the movement thereof generally toward the horizontal.

12. The completion apparatus of claim 11 wherein said means includes at least a pair of guide means through which said directed string is directed to re-direct its movement from the generally vertical to the generally horizontal.

13. The completion apparatus of claim 9 wherein said storage rack includes a generally circular track.

14. The completion apparatus of claim 9 including a threaded joint between a lowermost section of the assembled drill string and an upper most section of said slotted casing string, and said slotted casing string is smaller in diameter than said well borehole to enable said slotted casing string to be pushed to a production zone thereof by said drill string.

15. The completion apparatus of claim 14 wherein:

(a) said slotted casing string comprises two or more joints of slotted casing threaded together at slotted casing joints;

(b) the direction of said threaded joint between said lowermost section of the assembled drill string and said upper most section of said slotted casing string is opposite to the direction of said slotted casing joints thereby allowing said drill string to be separated from said slotted casing string by rotation of said drill string; and (c) said threaded joint receives the lower end of an intermediate casing string subsequent to said separation of said drill string from said casing string.

16. The completion apparatus of claim 15 including a spaghetti string which (a) is terminated at a lower end by a nozzle, (b) is extending along said intermediate casing string to said slotted casing string, and (c) fluid is passed there through and out through said nozzle to wash earth materials from said slotted casing string.

17. A method usable to complete a well drilled with a typical well drilling apparatus, which well drilling apparatus incorporates a means for withdrawing an elongate drill string from a well borehole drilled with the well drilling apparatus, the method comprising:

(a) providing a generally horizontal storage rack adapted to receive and store said elongated drill string thereon, (b) providing a mud line connected to said drill string and with a supply of drilling mud, and further being adapted to releasably connected with said drill string for controllably supplying drilling, mud thereto:

(c) providing a slotted casing string;

(d) connecting said slotted casing string to the lower end of said drill string; and (e) forcing into vertical and deviated sections of said well borehole said slotted casing string by inserting said drill string into said well borehole.

18. The method of claim 17 including the steps of:

(a) providing a vertical chain drive for mooring said drill string relative to an opening of the well borehole; and (b) inserting said drill string and said attached slotted casing string into said well borehole with said vertical drive chain.

19. The method of 18 wherein said slotted casing string is conveyed through said deviated sections of said well borehole.

20. The method of claim 18 including the steps of:

(a) disconnecting said slotted casing string from said drill string when said slotted casing string is positioned in a production zone;

(b) withdrawing said drill string generally vertically from said well borehole with said vertical chain drive thereby leaving said slotted casing string positioned in said production zone; and (c) redirecting the movement of said withdrawn drill string generally toward the horizontal.

21. The method of claim 20 including the step of storing said withdrawn drill string on said generally horizontal storage rack.

22. The method of claim 20 including the steps of:

(a) connecting said slotted casing string to said drill string by means of a threaded joint, and (b) after positioning in said production zone, disconnecting said slotted casing string from said drill string by rotating said drill string.

23. The method of claim 20 comprising the additional steps of:

(a) lowering intermediate casing into said well borehole so that a lower end of said intermediate casing contacts the top of said slotted casing string and an upper end of said intermediate casing extends into a surface casing within said well borehole; and (b) filling an annulus defined by the outer diameter of said intermediate casing and said well borehole wall with cement.

24. The method of claim 23 comprising the additional steps of (a) providing a spaghetti string terminated at a lower end by a nozzle;

(b) extending said spaghetti string and nozzle along said intermediate casing string to said slotted casing string, and (c) passing fluid through said spaghetti string and out through said nozzle to wash earth materials from said slotted casing string.

25. The method of claim 24 comprising the additional step of providing said intermediate casing string with spacers so that it is radially centered within said borehole in deviated sections of said well borehole.

* * * * *